US005179879A

United States Patent [19]

Yerly

[11] Patent Number: 5,179,879

[45] Date of Patent: Jan. 19, 1993

[54] PROCESS FOR CONTROLLING THE PARALLELISM OF THE TWO BEAMS OF A PRESS USED FOR CUTTING SHEET OR WEBLIKE MATTER DESTINED TO BE CONVERTED INTO A PACKAGE

[75] Inventor: Marcel Yerly, Jouxtens, Switzerland

[73] Assignee: Bobst SA, Switzerland

[21] Appl. No.: 691,438

[22] Filed: Apr. 25, 1991

[30] Foreign Application Priority Data

Apr. 25, 1990 [CH] Switzerland ..... 01403/90

[51] Int. Cl.[5] ..... B26D 7/26

[52] U.S. Cl. ..... 83/34; 83/527; 83/258; 83/604; 100/258 R

[58] Field of Search ..... 83/34, 361, 370, 527, 83/531, 561, 627, 248, 604, 630, 74, 75, 76.6–76.9, 640, 641, 368, 258; 100/258 R, 258 A; 72/21, 446, 448

[56] References Cited

U.S. PATENT DOCUMENTS

| | | | |
|---|---|---|---|
| 2,339,359 | 1/1944 | Shayne et al. | 83/74 |
| 2,850,130 | 9/1958 | Mater | 83/74 |
| 3,998,139 | 12/1976 | Bolliger | 83/527 |
| 4,697,485 | 10/1987 | Raney | 83/76.8 |

*Primary Examiner*—Douglas D. Watts
*Assistant Examiner*—Allan M. Schrock
*Attorney, Agent, or Firm*—Hill, Van Santen, Steadman & Simpson

[57] ABSTRACT

The invention concerns a process for regulating the parallelism of two beams of a cutting press designed for converting sheet or weblike matter into a package. The press comprises a frame made of a lower crossbar and an upper crossbar, connected to one another by means of lateral posts. An upper beam is fitted on the upper crossbar. A lower movable beam is raised and lowered with each operating cycle by means of a drive system supported by the lower crossbar by means of bearings. The bearings can be shifted vertically when the drive system is situated in a lower dead center position in such a way as to regulate the parallelism of the lower beam with regard to the upper beam. When the press accomplishes its operating cycle, a deviation e from parallelism is measured when the drive system is situated in an upper dead center position. When the lower dead center is reached, the bearings are shifted vertically so as to have the lower beam tilt in a direction contrary to the tilt resulting from the deviation of parallelism measured in the upper dead center position.

13 Claims, 5 Drawing Sheets

PROCESS FOR CONTROLLING THE PARALLELISM OF THE TWO BEAMS OF A PRESS USED FOR CUTTING SHEET OR WEBLIKE MATTER DESTINED TO BE CONVERTED INTO A PACKAGE

BACKGROUND OF THE INVENTION

The present invention concerns a cutting press, especially one used for cutting sheet or weblike matter to be converted into a package.

For the cutting action, the upward and downward motion of a lower beam of such a press can be achieved by means of a system comprised of four crankshaft and pull-rod units, or of four toggle lever and cam units. The upper dead center of the drive system corresponds to the processing, e.g. cutting position of the press, in which the tool counter-part fitted on the movable lower beam is pressed against the tool fitted on the upper beam.

For increasing productivity, such presses are designed in such a way that on the occasion of a same processing action, several blanks of identical shape and dimensions may be obtained simultaneously from a single sheet, the total surface of which is at least equal to the sum of all blanks. This means that the tool and the tool counter-part are both of platelike, generally rectangular, shape of large dimensions, carrying the processing tools on one of its sides, the other side being in contact with a side of the corresponding beam, which side, though, has a surface at least equal to, if not larger than, the tool surface or counter-part tool surface of the tool.

Considering that a perfect parallelism between the tool and the tool counter-part is the primary condition for obtaining a dependable cutting throughout the surface of the cardboard sheet to be cut out, the condition can be fulfilled only if the two beam surfaces carrying the tools and the tool counter-parts, i.e. the processing areas, are perfectly parallel to one another, at least during the cutting action, i.e. when the drive system is situated in an upper dead center position.

With a view to achieving the parallelism of the two beams, the Swiss Patent CH-A-57814 has proposed to act on the four bearings holding the crankshaft and pull-rod units on the lower crossbar of the press frame. The bearings are fitted so as to be shiftable vertically by means of various trapezoid wedges arranged pairwise between the various bearings and the bottom of a sliding rail in the lower crossbar. By shifting the wedges, it is possible to vertically vary the position of the bearings and, thereby, of the lower movable beam. Adequate regulation of the height of the four bearings will thus permit an initial parallelism which will later on have to be perfected by a so-called make-ready operation comprised of adding short bits of narrow adhesive paper on the back side of the tool opposite the cutting rules or other processing organs so as to compensate a residual deficiency of parallelism as well as shortcomings caused by the cutting rules. However, the make-ready operation has the disadvantage of requiring much working time and the involvement of human know-how.

The Swiss Patent CH-A-652967 describes a cutting press of which the drive system of the movable lower beam consists of a system with four toggle lever and cam units. The parallelism between the two beams is achieved by means of a single wedge inserted between the toggle lever bearings and the lower crossbar of the frame. In such a case, the make-ready operation is also necessary.

Moreover, considering that a cutting press is also designed so as to enable the same tool to be used for sheets of different dimensions, certain sheets might cover generally only part of the total tool area. So, on account of the fact that the sheet is generally arranged during the cutting action at the downstream end of the tool when referring to the sheet travelling direction, this partial occupation of the processing area of the tool causes uneven application of the cutting pressure with the unevenness propagating to the lateral posts of the frame. This causes different values of lengthening there among them and thus a lack of parallelism between the two beams.

The unevenness of the pressure applied, though, has the serious inconvenience of causing rapid wear and tear of the cutting rules.

For compensating this unevenness, users generally resort to the above-mentioned make-ready method as well as to at least one compensating die containing some cutting rules or other processing devices and fitted at the upstream end of the tool so as to obtain full parallelism of the tools. Nonetheless, even in such a case, the make-ready operation would lead too far.

As happens frequently with a cutting press processing sheets of a partial size, it is obvious that with the make-ready operation discarded, or at least reduced to a mere minimum, a considerable amount of time would thus be saved when preparing the tool.

SUMMARY OF THE INVENTION

It is an object of the present invention to regulate the parallelism of the two beams of a cutting press so as to enable it to provide full parallelism between the two beams when under pressure, and to shorten the time needed for the preparation of the tool by almost entirely eliminating the make-ready operation and the use of compensating dies.

According to the invention, parallelism of two beams of a cutting press designed for converting sheet or weblike matter into a package is regulated. For each operating cycle, at least one beam is movable with respect to the other between a first position in which the two beams are separated from one another, and a second position in which they are in pressure contact. In the course of the operating cycle, a deviation from parallelism of the beams is measured when they are in a second pressure position. In a first position with the beams separated, the parallelism of the beams is regulated in a direction enabling a correction of the measured deviation from parallelism.

DESCRIPTION OF THE PREFERRED EMBODIMENTS

Figure 1:
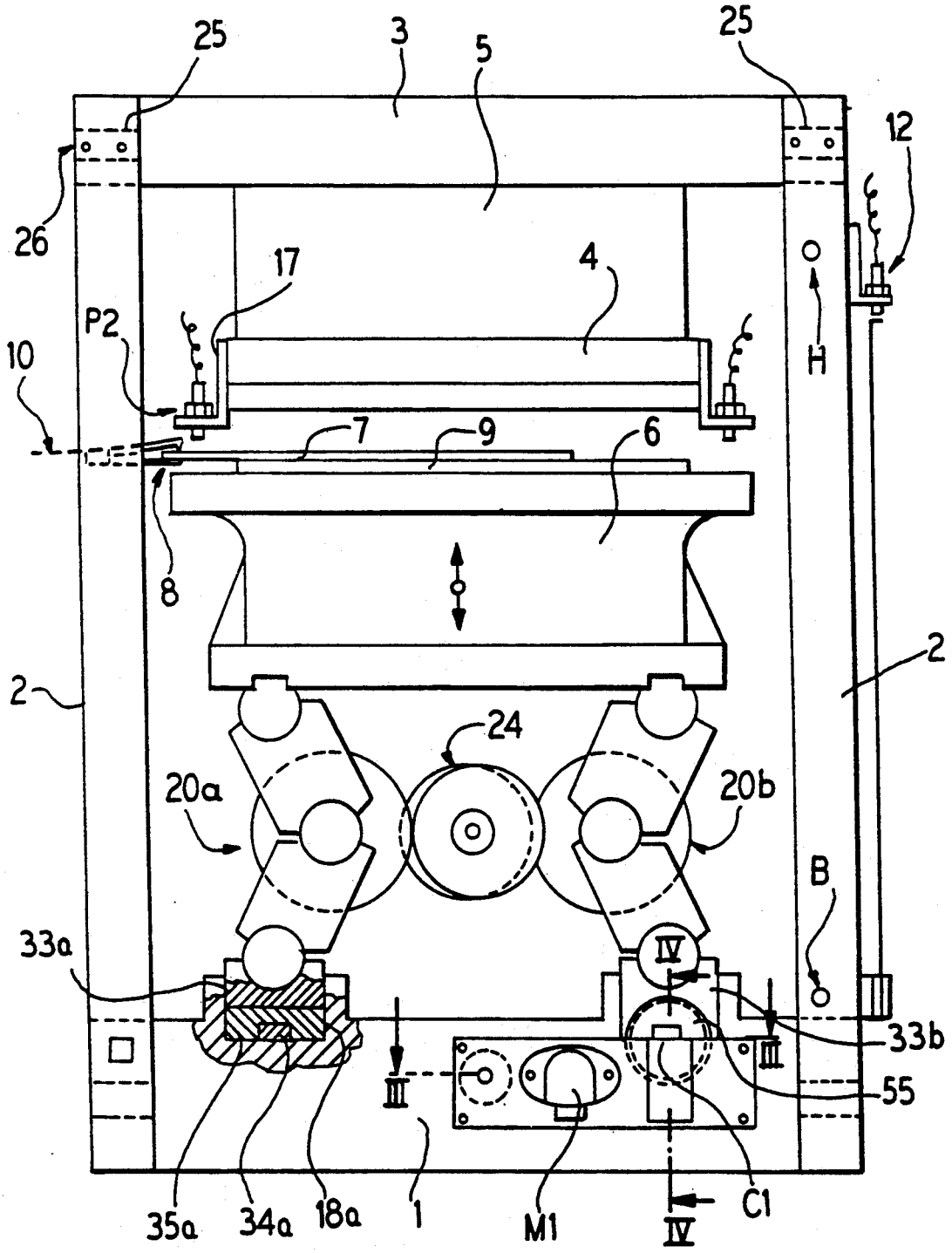
FIG. 1 represents a lateral view in partial section of a cutting press.

FIG. 1 represents a cutting press comprising a frame having an upper crossbar 3, a lower crossbar 1, and lateral posts 2 connected to the crossbars 1, 3 by means of screws 26 and rails 25 engaged in corresponding grooves added to the crossbars 1, 3. An upper beam 5 is fitted on the upper crossbar 3. A tool 4 is fitted on the lower surface of the beam 5. A lower, mobile beam 6 is movable by means of a drive system with four toggle levers 20*a*, 20*b*, and cams 24. The toggle levers 20*a*, 20*b* are supported by the bearings 33*a*, 33*b* fitted on the lower crossbar 1. The four toggle levers are arranged in two pairs of which one, 20*a*, is situated at the machine infeed end for the sheet 7, i.e. at the upstream end, and the other pair 20*b* is positioned downstream at the outlet end.

At a further stage, in order to comply with the necessity of better understanding of the invention, it is intended to add the mark a to the reference signs referring to the components situated upstream, as well as the mark b to the downstream components. Furthermore, the upstream/downstream sense will be superseded by the wording lengthwise direction of the machine, and the perpendicular sense by the crosswise direction.

When the drive system stands in an upper dead center position which, as already mentioned above, corresponds to the cutting action properly speaking, the sheet 7, previously brought along by a gripper bar 8 itself carried by laterally arranged carrier chains 10 onto a tool counter-part 9 situated on the lower movable beam 6, is then pressed against the tool 4. In such a press, the sheet 7 is placed against the downstream end of the tool 4 so that the gripper bar 8, when the cutting takes place, will be situated outside the space between the two beams 5, 6.

The bearing 33*a*, 33*b* of every toggle lever 20*a*, 20*b* is fitted so as to be able to shift vertically within a groove 35*a*, 35*b*, acting as a sliding rail at the lower crossbar 1. Between the bearings 33*a*, 33*b* and the bottom of the sliding rails 35*a*, 35*b*, there are trapezoid wedges 18*a*, 18*b* arranged so that their crosswise shift will permit the regulation of the height of the corresponding bearings 33*a*, 33*b*, and thus the regulation of the processing pressure and likewise of the parallelism of the two beams 5, 6 with regard to one another, as already described above.

Attention is to be drawn to the fact that, up to now, the regulation of the parallelism is comprised of regulating the height of the bearings 33*a*, 33*b* by means of the wedges 18*a*, 18*b* to be shifted individually or pairwise upstream and downstream when the toggle lever units 20*a*, 20*b* were in the upper dead center position. In other words, when in the lower dead center position, the lower movable beam 6 was positioned in exactly parallel fashion on the upper beam 5. Then, the shifting of the four wedges 18*a*, 18*b* in the same direction and in the same amount is allowed to appropriately regulate the processing pressure.

Although up to now the regulation of pressure by means of the wedges 18*a*, 18*b* has been achieved satisfactorily, this was always the case with the regulation of the parallelism between the two beams 5, 6. In fact, even after optimally accurate regulation of the parallelism, experience revealed that the thickness of the make-ready addition in certain areas of the tool 4 always would remain excessive. This meant that even with the two beams 5, 6 in full parallelism at the outset of the lower beam 6 moving upward, this very parallelism would get lost at the upper dead center reached by the drive system 20*a*, 20*b*, i.e. when the cutting pressure would act on the assembly of the press frame components.

When investigating into the causes of deficient parallelism between the beams 5, 6, it has been noticed that the dimensions or the size of the sheets to be processed played a more important role than had been imagined up to then. In fact, as already mentioned above, the sheet 7 with smaller dimensions than the tool 4 is arranged close to the downstream edge of the tool 4, and is centered crosswise with respect to the latter.

Figure 2:
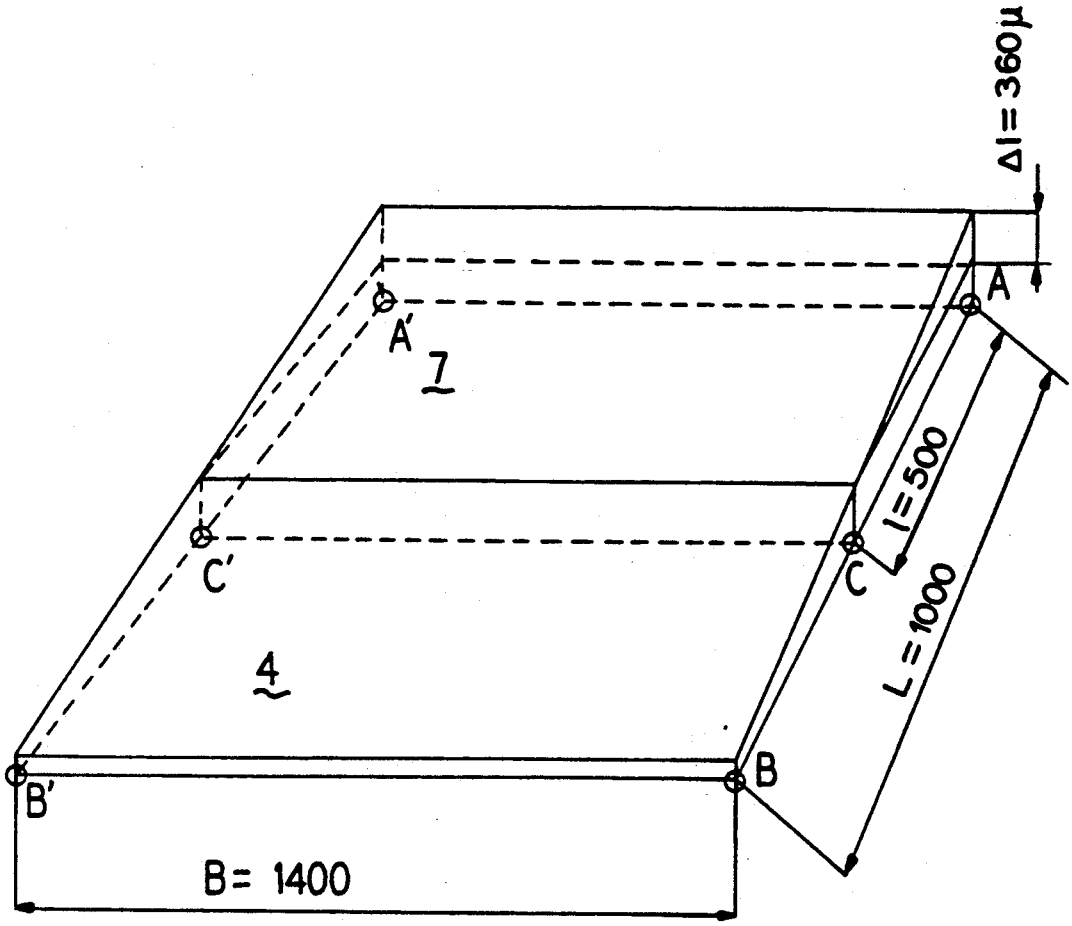
FIG. 2 schematically represents the relative displacement of the two beams of a cutting press when under pressure.

Appropriate tests have been carried out with a view to investigating into the variations of parallelism between the two beams 5, 6 of a cutting press in relationship with the size of a sheet to be cut. The results of one of these tests are shown by FIG. 2. Horizontally, this figure represents schematically the tool 4 with the length AB (or A'B') longitudinally, and with the width AA' (or BB)', as well as the sheet with the length AC (A'C') and the width AA' (or BB'). The length of the tool 4 is 100 cm and the length of the sheet is 50 cm, their width being identical and equal to 140 cm. The sheet 7 thus has half the size of the tool 4.

The tests were undertaken by means of jacks situated between the two beams 5, 6 in order to apply a pressure of 3 Mn uniformly on the whole surface of the processing areas of the two beams 5, 6 (the sheet 7 of the half-size being arranged in the downstream part of the tool), and to then measure at various points of the processing areas the relative displacement of a beam with regard to the other. This relative displacement is represented vertically by FIG. 2. This test has been carried out when the toggle levers 20*a*, 20*b* were in the upper dead center position in order to optimally simulate the real operating conditions of the press. FIG. 2 clearly shows a very strong tilt of the lower side of the upper beam 5 with regard to the upper side of the lower beam 6, the tilt occurring almost only lengthwise but not crosswise. Measurements have revealed that the difference $\Delta l$ between the displacement value at the downstream edge AA' of the sheet 7 and at the upstream edge CC' amounted to 360 $\mu$m. However, this value is exactly the one providing the corrective value of the make-ready correction to be carried out in order to compensate the lack of parallelism. For professionals, it is obvious that applying a make-ready correction for compensating differences of height of such amounts on a large part of the operating size is a delicate operation absorbing much time.

Further tests have also been carried out with sheets of crosswise reduced sizes. In such cases, though, the crosswise tilt of a beam with regard to the other is so small in comparison with the lengthwise tilt, that it can generally be neglected. In other words, especially broad sheets of partial size will entail the necessity of resorting to an important make-ready correction, allowing compensation for the lack of parallelism between the two beams of a cutting press.

Consequently, the tests described above have also revealed the inappropriateness, in the event of partial operating sizes, of the regulation process in current use up to now and consisting in acting on the vertical position of the bearings 33*a*, 33*b* of the drive system 20*a*, 20*b* so as to put the lower movable beam 6 into a perfectly parallel position with regard to the upper beam 5 with the latter in the lower dead center position, since the partial operating sizes would almost entirely impair the parallelism in the upper dead center position.

The basic idea of the invention, having led to the solution of the above indicated problem, is in having the ascending lower movable beam 6 carry out a tilting movement somehow contrary to the one it effectuated up to now, i.e. in having the lower beam 6, when in its lower dead center, in a slanting position with regard to the upper beam 5 so that, when the latter reaches the upper dead center, the beams 5, 6 will be parallel to one another owing to the forces of the operating pressure.

When doing so, the point to determine was, however, according to what sort of criteria and to which amplitude the lower beam 6 when staying in the lower dead center position should be tilted with respect to the upper beam 5. In order to remain as close as possible to the real operating conditions of the press, the decision was reached to directly measure at various points the distance between the two operating surfaces of the beams 5, 6 exactly when the cutting force would be at its maximum rate, i.e. with the beam in the upper dead center position, to then compare the measurements to one another in order to determine the direction and amplitude of the tilting effect; and before the cutting operation properly speaking, to position the lower beam 6 according to an exactly contrary tilt and with identical amplitude or, at any rate, proportionally to the one measured.

Considering the above arguments regarding the tilting effect referred to, it becomes obvious that in the present case and especially so with cutting sheets of partial size and centered crosswise on the tool, it would be adequate to measure the distance referred to at two points of which one should be situated between the upstream edges, and the other between the downstream edges of the two beams 5, 6. For this purpose, the upper beam 5 is to be provided with two proximity sensors $P_1$, $P_2$, fitted by means of corner pieces 17*a*, 17*b* in the lower area of the crosswise vertical upstream and downstream sides of the beam 5, and opposite a point of the lower beam 6 which should be covered neither by the gripper bar 8 nor by the sheet 7 nor by the tool counter-part 9. So, when the lower movable beam 6 will be put under pressure when getting in touch with the upper beam 5, the two sensors $P_1$, $P_2$ will indicate the exact distance existing between the upstream and downstream edges of the two beams 5, 6. A comparison of the two measurements signalled by the two sensors $P_1$, $P_2$ will allow the tilting action to be properly evaluated.

An interesting fact to be set forth is that the measuring of the parallelism is effected in the actual production zone at the moment when the first sheets of a new run to be cut are carried in by the gripper bar 8 between the two beams 5, 6 of the press. At this stage, a professional will become aware of a simple method permitting a setting of the measurement. Quite obviously, the infinitesimal values of some hundreds of a micron entering into account, the values measured will generally have to be displayed on a screen (not represented).

An additional task involves the modification of the height of the four bearings 33*a*, 33*b* of the toggle levers 20*a*, 20*b* so as to have the lower beam 6 tilt, generally from a position parallel to the upper beam 5, contrary and proportional to the tilt measured by the sensors $P_1$, $P_2$. In this connection, several possibilities would be envisaged.

A first approach might be in having a comparator analyze the two values signalled by the sensors $P_1$, $P_2$, in displaying their difference and in shifting the bearings 33*a*, 33*b* vertically until the difference displayed would become nil. However, this solution cannot be realized. In fact, as such a regulation should be carried out at an upper dead center position, i.e. in full operating pressure, it is impossible to act at this very stage with a sufficient force on the bearings 33*a*, 33*b* by means of wedges or other means in order to cause each toggle lever 20*a*, 20*b* to rise or descend appropriately. Regulation is thus possible only close to the lower dead center position, as has always been the case up to now.

Moreover, following the above indicated considerations according to which lengthwise tilting in the downstream direction should be considered as an essential feature, it is possible to derive from this fact that the two bearings of both upstream and downstream pairs 33*a*, 33*b* respectively located under the two upstream and downstream toggle levers 20*a*, 20*b* respectively should undergo simultaneous vertical and identical regulation. In order to ensure simultaneous shifting either of the upstream wedge pair 18*a* or downstream pair 18*b*, an appropriate solution consists in fitting each pair 18*a*, 18*b* on a square bar 34*a* and 34*b* respectively which can be shifted along a sliding rail 35*a* and 35*b* respectively, as has already been described in Swiss Patent CH-A-575814, incorporated herein. The shift of the bars 34*a*, 34*b* also permits a simultaneous shift of the two upstream and downstream wedges 18*a* and 18*b*.

Figure 3:
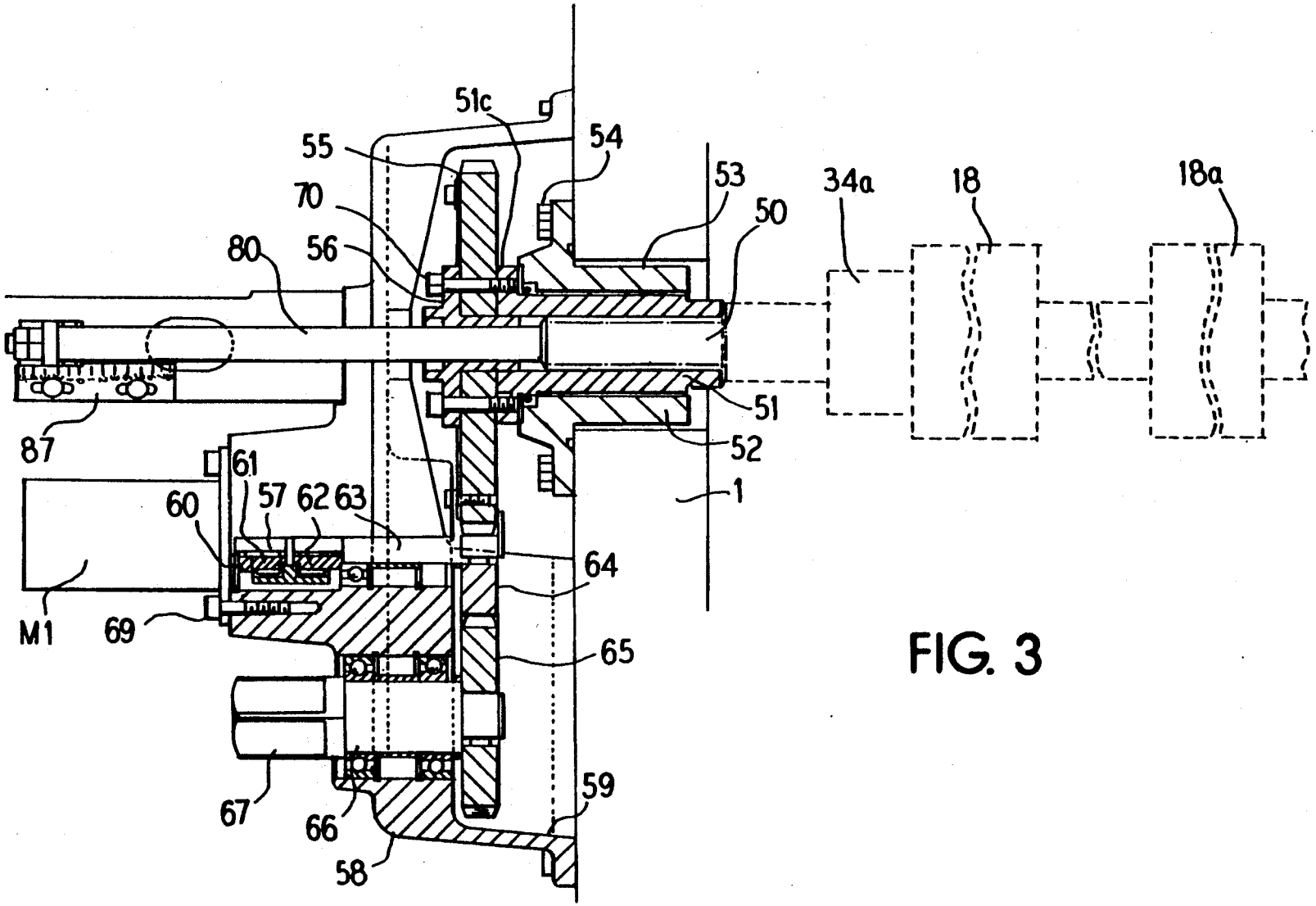
FIG. 3 represents a top view in section according to section line III—III of FIG. 1.
Figure 4:
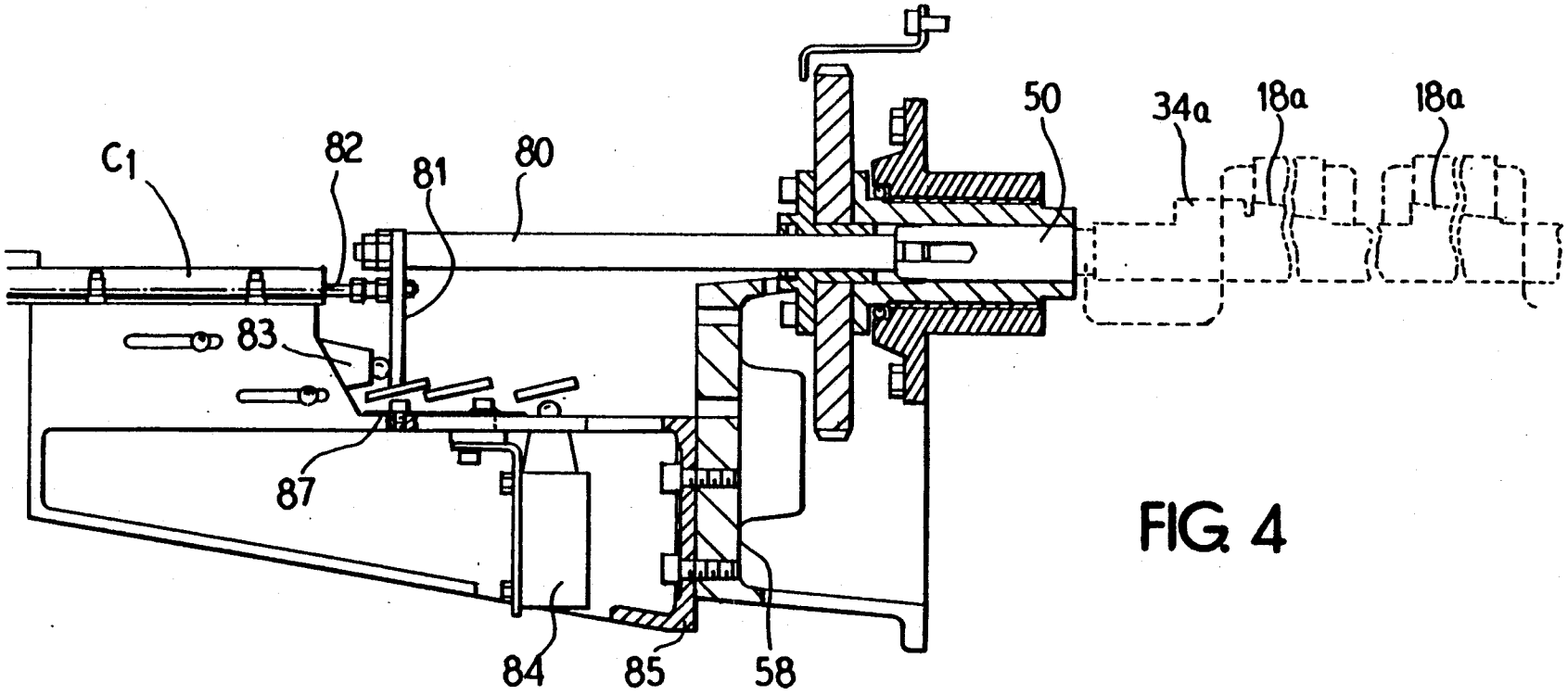
FIG. 4 represents a side view in partial section according to section line IV—IV of FIG. 1.

For achieving and measuring the shift of the bar 34*a*, it is foreseen to use a motor $M_1$ and a linear position sensor $C_1$, as shown by FIG. 1 and in greater detail by FIGS. 3 and 4 which, by the way, also represent schematically in dotted lines the two upstream wedges 18*a* fitted in a known way on the bar 34*a*, as well as the two bearings 33*a*. In FIG. 1, the motor $M_2$ and the linear position sensor $C_2$ acting on the bar 34*b* are not represented. See also the sectional view in FIG. 4 according to section line IV—IV of FIG. 1. The end of the bar 34*a*, situated generally on the operator's side, is provided with a threaded part or extension 50 engaging in an inner corresponding threading of a hollow axle 51 fitted for appropriate rotation by means of a smooth bearing 52 insice a bearing 53, itself fitted by means of a screw 54 on the lower crossbar 1 of the frame. The hollow axle 51 is provided with a flange 51*c*. A first toothed wheel 55 provided with a hub 56 is locked against rotation with the hollow axle 51 by means of the screws 70 passing through the hub 56 and the flange 51*c*. The hydraulic motor $M_1$ is fitted on the main support 58 by means of the screw 69, the support 58 being itself fitted on the lower crossbar 1 by means of the screw 59. On the outlet shaft 57 of the motor $M_1$, a second toothed wheel 60 is cottered on and is engaged in a gear situated inside a free hollow sleeve 61. An auxiliary shaft 63 is able to rotate within a corresponding bore of the support 58 and within the extension of the outlet shaft 57 of the motor $M_1$. At the first end of the auxiliary shaft 63, a toothed wheel 62 is cottered on and is engaged in the inner gear of the hollow sleeve 61, whereas the other end bears a first pinion 64 cottered on and engaged in the first toothed wheel 55. FIG. 3 shows that the rotation of the pinion 64 ensured by the motor $M_1$ in the one or the other direction causes a corresponding shift of the bar 34*a* and hence of the upstream wedges 18*a*.

In order to ensure also a manual drive of the outlet pinion 64, it is foreseen to use an auxiliary pinion 65 engaged in the outlet pinion 64 and cottered on the axle 66 itself rotating inside a corresponding bore of the support 58. The axle 66 protrudes with a hexagonal part 67 from the support 58, thus allowing it to be rotated manually by means of a wrench.

With a view to measuring the shift and the position of the bar 34, the latter has been extended (as a rule also on the operator's side, i.e. on the side of its threaded part or extension 50) by means of a rod 80 passing freely through the corresponding bore added to the hub 56 of the toothed wheel 55. The free end of the rod 80 carries a plate 81. The end of the outlet rod 82 of the linear position sensor $C_1$ is fitted on the plate 81 and can be adjusted. The linear sensor $C_1$ is fitted in an adjustable position on the auxiliary support 85, itself fitted on the main support 58. The auxiliary support 85 carries also two adjustable end stops 83, 84, the purpose of which is to cut power flowing into the system in case the bar 34*a* would be shifted out of the stroke range limited by the two end stops 83, 84. A graduated rule 87 fitted on the auxiliary support 85 close to the plate 81 provides the operator with a first visual approximation of the shift and the position of the bar 34*a*.

For ensuring and measuring the shift of the downstream bar 34*b*, a device identical to the one described above for the upstream bar 34*a* is used, through with the difference that the hydraulic motor is indicated by means of reference $M_2$ and the linear position sensor by means of $C_2$.

Figure 5:
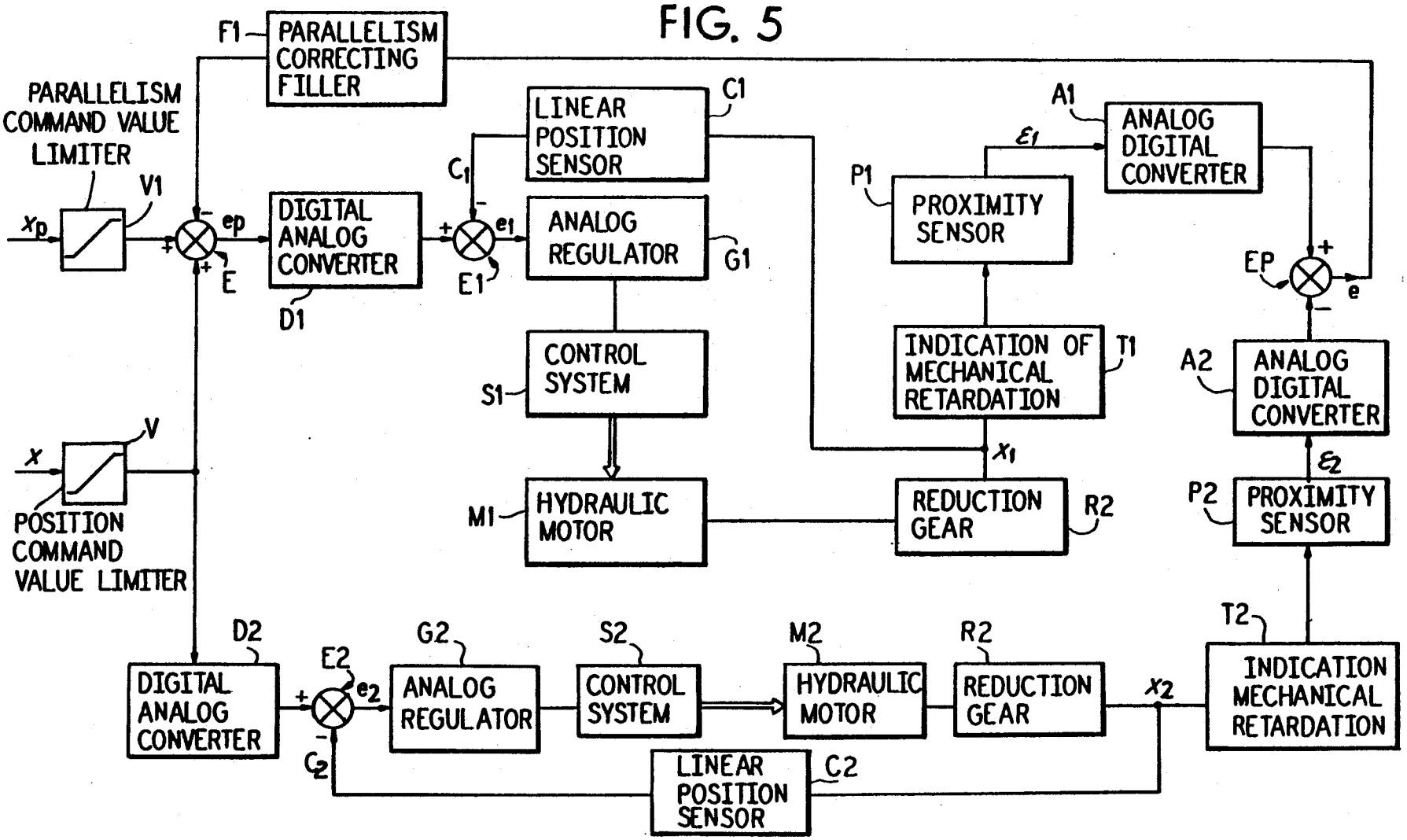
FIG. 5 represents a functional diagram for the control of the two motors used for regulating the parallelism of the beams.

FIG. 5 represents the functional diagram of the control ensured by the two hydraulic motors $M_1$, $M_2$ according to a way of realization with which:

- the motor $M_1$ is to shift the upstream wedges 18*a*, i.e. the upstream bar 34*a*,
- the motor $M_2$ is to shift the downstream wedges 18*b*, i.e. the downstream bar 34*b*,
- the regulation of the operating pressure achieved in lower dead center position is initialized by inputting a position command value x identical for both linear position sensors $C_1$, $C_2$ and corresponding to the desired operating pressure, this value being basically determined by the operator essentially with regard to the job necessities, hardness, thickness, and composition of the sheets to be processed, as well as to the operator expertise, and
- the regulation of the parallelism of the beams 5, 6 is achieved by exclusively acting on the two upstream wedges 18*a* so as to have the lower beam 6 tilt in the downstream, i.e. lengthwise, direction.

For adjusting the position of the downstream bar 34*b*, the position command value x travels in a first phase through a saturation controlled value limiter V and then through a digital-analog converter $D_2$, and a comparator $E_2$ which compares the command value x to the real position $c_2$ provided by the linear position sensor $C_2$. There difference $c_2$ is successively transmitted to an analog regulator $G_2$ and a control system $S_2$ of the hydraulic motor $M_2$. When the motor $M_2$ is started up, it will act on the reduction gear $R_2$ formed in the present case of the pinion 64 and the toothed wheel 55. So, when the latter toothed wheel 55 is driven, the bar 34*b* is shifted through a distance $x_2$, and likewise the outlet rod of the linear sensor $C_2$ which at this very instant will emit a new position value $c_2$ which will be entered into the comparator $E_2$ in order to provide a closed loop command for positioning the bar 34*b*. On the diagram, the influence of the output $x_2$ of the reduction gear $R_2$ is represented by the box $T_2$ as an indication of the dynamics of the mechanical retardation system acting between the outlet of the reduction gear $R_2$ and the proximity sensor $P_2$. In the event of the difference $e_2 = x - c_2$ being nil, the positioning of the downstream bar 34*b* with a view to obtaining the required operating pressure is practically accomplished at this stage.

The control circuit of the motor $M_1$ is identical and parallel (c.f. the diagram on which the items referring to the upstream end bear the indication 1), though with the difference that the position command value x, before passing through the digital-to-analog converter $D_1$, will be fed into an intermediary comparator E becoming active when the parallelism of the two beams 5, 6 is regulated.

As for the regulation of the pressure, the operator can proceed to a first cutting test with a sheet of the new run in order to check whether in the upper dead center position the required operating pressure is really attained when the position command value x is entered and the wedges 18*a*, 18*b* are finally positioned. The cutting strength indicated in MN is measured, for instance, by means of an inductive shift sensor 12 measuring the relative displacement between an upper point H and a lower point B of the frame. The sensor 12 is situated at the upper point H, a rod 13 being arranged between the two points H, B and fitted only with one of its ends at the lower point B. The other free end acts on the sensor 12. Such a measuring device is sufficiently known, thus requiring no detailed description. If the pressure measured in the upper dead center position does not have the value expected, the operator will have to put in a new position command value x. This test can be repeated several times until the required pressure will be obtained. An essential feature is the fact that the pressure is regulated quickly and easily since the whole process takes place automatically, generally requiring no manual action.

Simultaneously, with the regulation of the operating pressure, the parallelism of the beams 5, 6 is regulated. For this purpose, the proximity sensors $P_1$, $P_2$ will indicate the distances $e_1$, $e_2$ between the two beams 5, 6 both at the upstream and downstream end when the drive system 20*a*, 20*b* is in a dead center position. After having passed through an analog-to-digital converter $A_1$, $A_2$, these distance values $e_1$, $e_2$ are fed into a distance comparator $E_2$. The difference of these two distance values $e_1$, $e_2$ provides the value and the direction of the parallelism deviation e which, after passing through a numeric-type corrective filter F built into a micro-tester and destined to filter out the random deviation, will be fed into the parallelism comparator E. After passage through a value limiter $V_1$, a parallelism command value $x_p$ is fed into the parallelism comparator E. In this way, the parallelism deviation e is compared to the parallelism command value $x_p$, and their difference $e_p$ is put into the digital/analog converter $D_1$ and thereafter into the closed loop control circuit of the motor $M_1$ regulating the position of the upstream bar 34*a* and thereby the upstream wedges 18*a*.

The parallelism command rate $x_p$ is an infinitesimal value sensitive to the slightest variations of the operating conditions of the press, to the type of the run processed, as well as to other features such as those already mentioned above in connection with the regulation of the operating pressure. However, it may suffice to refer to the basic principle already mentioned, i.e. to the fact that the parallelism command value $x_p$ is adopted so as to allow in a lower dead center position a relative tilt of the beams 5, 6 which would be contrary to the one measured by means of the proximity sensors $P_1$, $P_2$ when the beam is in an upper dead center position.

Moreover, the operator is able to vary the parallelism command value $x_p$ on the basis of his findings after checking the die-cut sheet as well as using his experience.

Since the make-ready is almost eliminated as has been shown above, the time necessary for the preparation of the press for a new cutting run is shortened by an important amount in comparison with the time used up to now. This preparation time is still further reduced in the case of sheets already processed beforehand; in such a case, the position command value x and the parallelism command value $x_p$ are already known from an earlier setting and memorization, and will only have to be fed into the regulating system.

Modifications can be added to the process described above without the limits of the invention being exceeded. So, for instance, the successive sheets can be connected to one another by linking points so as to make up a web travelling through the cutting press. Moreover, the press can be provided with a movable upper beam and a fixed lower beam, as described in Swiss Patent CH-A-363666, incorporated herein. In such a case, deviations of parallelism would originate from the lengthening of the pull rods connecting the upper movable beam to the drive system fitted on a lower crossbar of the machine frame.

Although various minor changes and modifications might be proposed by those skilled in the art, it will be understood that I wish to include within the claims of the patent warranted hereon all such changes and modifications as reasonably come within my contribution to the art.

I claim as my invention:

1. A method for regulating parallelism of two beams of a cutting press designed for converting sheet or weblike matter into a package, and wherein for each operating cycle, at least one beam is movable with respect to the other between a first position in which the two beams are separated from one another, and a second position in which they are in pressure contact, comprising the steps of:

in the course of an operating cycle of the press, measuring a deviation e from parallelism of the beams when they are in the second pressure position; and in the first position with the beams separated, regulating parallelism of the beams in a direction enabling a correction of the measured deviation e from parallelism.

2. A method for regulating parallelism of two beams of a cutting press designed for converting sheet or weblike matter into a package, comprising the steps of:

providing the press with a frame made of a lower crossbar and an upper crossbar connected to one another by means of lateral posts, an upper fixed beam being mounted to the upper crossbar and a lower movable beam being raised and lowered with each operating cycle by a drive system having bearings connected to the lower crossbar;

during an operating cycle of the press, measuring a deviation from parallelism e when the drive system is situated in an upper dead center position; and when a lower dead center position is reached, vertically shifting said bearings so as to have the lower beam tilt in a direction contrary to a tilt resulting from the deviation from parallelism e measured in the upper dead center position so as to regulate parallelism of the lower beam with respect to the upper beam.

3. A method according to claim 2 wherein said deviation from parallelism e is measured by proximity sensors fitted on at least one beam, and a vertical position of the bearings being determined by at least one position sensor.

4. A method according to claim 3 including the steps of:

providing two upstream and two downstream bearings for the drive system;

regulating the vertical position of the bearings by wedges positioned between the bearings and the lower crossbar of the frame, the wedges being fitted in pair-wise fashion upstream and downstream on respective crosswise upstream and downstream bars, the bars being movable independently from one another;

fitting the proximity sensors on at least one beam so as to allow the measuring of the deviation e from parallelism causing a downstream or upstream tilting of one of the beams with respect to the other;

shifting only the wedges likely to cause tilting of the lower beam which is contrary to the one measured; and a position of each of the upstream and downstream crosswise bars being determined by respective position sensors.

5. A method according to claim 4 including the step of shifting the upstream and downstream bars by respective electric motors.

6. A method according to claim 5 including using the wedges for also regulating an operating pressure of the press by the steps of;

regulating the operating pressure by a command value identical to one of the two position sensors;

operating a control circuit of each motor with a closed loop so as to permit each of them to automatically cause respective shifts of the upstream and downstream crosswise bars until a position value given by each of the position sensors is identical to the command value; and using this same closed loop control circuit of one of the motors for regulating the parallelism of the two beams by feeding a parallelism command value into the control circuit.

7. A cutting press for converting sheet or weblike matter into a package, comprising:

a frame made of a lower crossbar and an upper crossbar connected to one another by lateral posts;

an upper fixed beam fitted on the upper crossbar;

a lower movable beam and drive system means for raising and lowering the lower movable beam with each operating cycle, the drive system being supported by bearings connected to the lower crossbar;

means for moving said bearings vertically when the drive system is situated in a lower dead center position so as to regulate a parallelism of the lower beam with respect to the upper beam;

proximity sensor means for measuring parallelism of the two beams when the upper and lower beams have been moved together to a pressure contact position for cutting the sheet or weblike matter;

position sensor means for determining a position of said means for moving the bearings;

said means for moving the bearings comprising wedges and a motor means for shifting the wedges; and control means having a closed loop for each motor means by which it is possible to feed in a position command value common to all position sensor means for regulating an operating pressure of the press, and said control means having a parallelism command value for at least one position sensor means for regulating parallelism of the two beams with respect to one another, said parallelism command value being derived from the measured parallelism of the proximity sensor means for said pressure contact position.

8. A cutting press according to claim 7 wherein said drive means is supported on the lower crossbars by two upstream bearings and two downstream bearings fitted on cross bars upstream and downstream, said drive means comprising an upstream drive and a downstream drive which are shiftable independently from one another; one end of each of the crossbars having a threaded extension engaging in a corresponding threading of a toothed wheel means for causing a shifting of the respective bar when the toothed wheel means revolves; and control motor means at each drive for respectively rotating the toothed wheel means.

9. A cutting press according to claim 8 including:

a pinion cottered on the first end of a shaft, said shaft being rotatable on a support which is itself fitted on the lower crossbar;

a second pinion cottered on the other end of said shaft and engaged with an inner gear of a hollow sleeve; and the inner gear being engaged with a third pinion cottered on an output shaft of said control motor means.

10. A cutting press according to claim 9 wherein said threaded extension has a rod whose free end is provided with a means for actuating said position sensor means.

11. A cutting press according to claim 10 wherein said means is arranged for contacting two stroke end stops.

12. A system for regulating parallelism of upper and lower beams of a cutting press having cutting tools and designed for converting sheet or weblike matter into a package, comprising:

means for permitting movement of at least one beam with respect to the other beam between a first position in which the two beams are separated from one another, and a second position in which the cutting tools are in pressure contact with the matter to be cut;

means for measuring a deviation e from parallelism of the beams when they are in the second pressure position; and means for regulating the parallelism of the beams in a direction enabling a correction of the measured deviation e from parallelism when the beams are in the first position and separated.

13. A method for regulating parallelism of two beams of a cutting press designed for converting sheet or weblike matter into a package, and wherein for each operating cycle, at least one beam is movable with respect to the other between a first position in which the two beams are in a maximum separated position from one another, and a second position in which associated cutting tools are in pressure contact, comprising the steps of:

in the course of an operating cycle of the press, measuring a deviation from parallelism of the beams when they are in the second pressure position; and in the first position with the beams fully separated, regulating parallelism of the beams in a direction enabling a correction of the measured deviation from parallelism.

* * * * *